US007921960B2

(12) United States Patent
Jacobson et al.

(10) Patent No.: US 7,921,960 B2
(45) Date of Patent: Apr. 12, 2011

(54) ACOUSTIC CABINET

(75) Inventors: Kenneth E. Jacobson, Owatonna, MN (US); Peter F. Menzel, Owatonna, MN (US); Rebecca S. Broton, Owatonna, MN (US); Mark R. Friedrichs, Owatonna, MN (US); Ronald R. Freiheit, Owatonna, MN (US)

(73) Assignee: Wenger Corporation, Owatonna, MN (US)

( * ) Notice: Subject to any disclaimer, the term of this patent is extended or adjusted under 35 U.S.C. 154(b) by 120 days.

(21) Appl. No.: 11/828,932

(22) Filed: Jul. 26, 2007

(65) Prior Publication Data

US 2008/0023266 A1 Jan. 31, 2008

Related U.S. Application Data

(60) Provisional application No. 60/833,370, filed on Jul. 26, 2006.

(51) Int. Cl.
*A47B 81/06* (2006.01)

(52) U.S. Cl. ..... 181/198; 181/30; 181/210; 181/194; 181/284

(58) Field of Classification Search ..... 181/210, 181/30, 198, 294, 284
See application file for complete search history.

(56) References Cited

U.S. PATENT DOCUMENTS

| | | | | | |
|---|---|---|---|---|---|
| 3,180,446 | A | | 4/1965 | Wenger | |
| 3,630,309 | A | | 12/1971 | Wenger et al. | |
| 4,274,506 | A | * | 6/1981 | Blomgren et al. | 181/210 |
| 4,325,597 | A | * | 4/1982 | Morrison | 312/258 |
| 4,339,018 | A | * | 7/1982 | Warnaka | 181/286 |
| 4,548,292 | A | | 10/1985 | Noxon | |
| 4,719,730 | A | | 1/1988 | Winkowski | |
| 4,826,265 | A | * | 5/1989 | Hockenberry | 312/326 |
| 4,998,598 | A | | 3/1991 | Mardian et al. | |
| 5,118,252 | A | * | 6/1992 | Chaney | 415/119 |
| 5,212,355 | A | * | 5/1993 | Edwards et al. | 181/290 |
| 5,371,987 | A | | 12/1994 | Hirsch et al. | |
| 5,416,285 | A | | 5/1995 | Niehaus | |
| 5,623,130 | A | | 4/1997 | Noxon | |
| 5,651,405 | A | | 7/1997 | Boeddeker et al. | |
| 5,700,052 | A | * | 12/1997 | Yamazaki et al. | 297/217.3 |

(Continued)

OTHER PUBLICATIONS

Wenger Brochure Reference; Total Storage Solutions for Music Suites; Wenger Corporation, Owatonna, Minnesota; 2003; (8 color sheets).

*Primary Examiner* — Elvin G Enad
*Assistant Examiner* — Forrest M Phillips
(74) *Attorney, Agent, or Firm* — Patterson Thuente Christensen Pedersen, P.A.

(57) ABSTRACT

The present invention is an acoustic cabinet for the storage of musical instruments. Acoustic cabinet can have a storage portion having a plurality of individual storage units contained therein. One or more grill doors can cover the open end of acoustic cabinet. The size, shape, and arrangement of grill bars of door can be configured to reduce the effect of resonance. Rear panel of acoustic cabinet can include one or more sound-absorbing panels that absorb sound as it passes through acoustic cabinet. A protective backing can also be disposed between sound-absorbing panels and individual storage spaces to protect the panels from damage when instruments and other objects are inserted into the storage spaces. A combination of a grill door and sound-absorbing panels can allow acoustic cabinet to have a net-absorptive effect on a rehearsal room. One or more acoustic cabinets can be strategically positioned throughout a rehearsal room for optimal acoustic performance.

20 Claims, 10 Drawing Sheets

U.S. PATENT DOCUMENTS 6,085,861 A 7/2000 Jines
6,158,178 A * 12/2000 Jeffers et al. ..... 52/220.7
6,470,700 B1 * 10/2002 Qiu et al. ..... 62/296
6,520,288 B1 2/2003 Quam et al.
6,725,968 B2 4/2004 Quam et al.
7,090,313 B1 * 8/2006 McMurray ..... 312/138.1
7,178,630 B1 * 2/2007 Perdue ..... 181/290
2003/0222462 A1 * 12/2003 Bruce ..... 292/216
2004/0188165 A1 * 9/2004 Miller et al. ..... 180/291
2006/0191743 A1 8/2006 Pike et al.

* cited by examiner

ACOUSTIC CABINET

PRIORITY CLAIM

The present application claims priority to U.S. Provisional Application No. 60/833,370, filed Jul. 26, 2006, and entitled "ACOUSTIC CABINET", which is herein incorporated by reference in its entirety.

FIELD OF THE INVENTION

The present disclosure relates to a cabinet for storing musical instruments in a music room and more particularly relates to a musical instrument storage cabinet that can improve the acoustics of a room.

BACKGROUND OF THE INVENTION

In any setting where noise is generated, furniture can tend to increase and distort the noise by reflecting sound waves around the room. Solutions to this problem have been developed for various settings. For example, U.S. Pat. No. 5,212,355 discloses a filing cabinet having sound absorptive properties. The filing cabinet has a door having metal front and rear panels with an intermediate layer of sound absorbing material in between. According to the specification, the door absorbs sound generated in the workplace, such as employee conversations, telephones, typewriters and other office equipment to create a more pleasant work environment. In another example, U.S. Pat. No. 4,325,597 discloses a furniture system that can be provided with sound-absorbent fabric layers and can also be used to improve the acoustics of an office. While these disclosures may be effective in reducing the noise generated in an office, they are not designed to enhance the acoustical performance of rehearsal rooms used for music rehearsal or performance.

Thus, there is a need for sound absorbing furniture used in music rooms, such as cabinets for storing musical instruments. Instrument storage cabinets are a necessity in all school music programs. Due to space constraints, however, many music programs only have space for their instrument storage in the rehearsal room. The acoustical impact of placing instrument storage cabinets in rehearsal rooms, though, can be significant.

A rehearsal room should provide an acoustic environment where the room acoustics neither enhance nor detract from the acoustic properties of the instruments but still provide a sense of support or ensemble to the musicians due to the time delay of the reflected sound energy (preferably in the range of 50-80 msec). Where storage cabinets are required to be kept in the rehearsal room, they decrease the cubic volume of the room and also tend to create specular reflections, which hamper the acoustic performance of the room. In addition, prolonged exposure to the sound generated in such rooms and reflected by prior art storage cabinets can lead to hearing loss.

In order to lessen their acoustical impact, musical instrument storage cabinets can be provided with a grill (as opposed to solid) door. Typically, there is a plurality of grill doors separably openable to provide individual access to each storage space in the cabinet. Each grill door is often comprised of a plurality of vertical bars and a single horizontal bar. Such grill doors increase sound diffusion by allowing the sound to pass into the cabinet, where it is scattered before it is reflected back out. However, the vertical bars of the grill door tend to resonate easily and may continue to vibrate for a significant time after playing has stopped. The resonance is intensified where the vertical bars are all of the same length, because they will all begin to resonate at the same frequency. Accordingly, it would be desirable for a musical instrument storage cabinet to utilize a door that decreases or eliminates the effect of resonance on the acoustical performance of a rehearsal room while still increasing the cubic volume of the room.

Even with a grill door, musical storage cabinets tend to reflect sound, which interferes with the acoustical performance of the room. One solution to this problem is to remove the back panel of the storage cabinet and push the cabinet against a sound-absorbing-panel that is located on a wall. This configuration allows more of the sound reaching the cabinet to be absorbed, rather than reflected. However, this technique is inefficient as separate purchases and installations must be made of the cabinet and the sound-absorbing panel. In addition, sound-absorbing panels are typically affixed to the wall, making relocation of the panels difficult and leaving marks behind in the wall if they are moved. Further, many rehearsal room are not big enough to accommodate wall-mounted sound-absorbing panels and musical storage cabinets. Accordingly, it would be desirable for there to be a simplified and more versatile way to provide sound absorption and musical instrument storage to a rehearsal room.

SUMMARY OF THE INVENTION

The present invention is directed to an acoustic cabinet for the storage of musical instruments. The acoustic cabinet can have a storage portion having a plurality of individual storage units contained therein. A grill door can cover the open end of acoustic cabinet. The size, shape, and arrangement of grill bars of door can be configured to reduce the effect of resonance. Rear panel of acoustic cabinet can include one or more sound-absorbing panels that absorb sound as it passes through acoustic cabinet. A protective backing can also be disposed between sound-absorbing panels and individual storage spaces to protect the panels from damage when instruments and other objects are inserted into the storage spaces. A combination of a grill door and sound-absorbing panels can allow acoustic cabinet to have a net-absorptive effect on a rehearsal room. One or more acoustic cabinets can be strategically positioned throughout a rehearsal room for optimal acoustic performance.

BRIEF DESCRIPTION OF THE DRAWINGS

The invention may be more completely understood in consideration of the following detailed description of various embodiments of the invention in connection with the accompanying drawings, in which.

DETAILED DESCRIPTION

Figure 1:
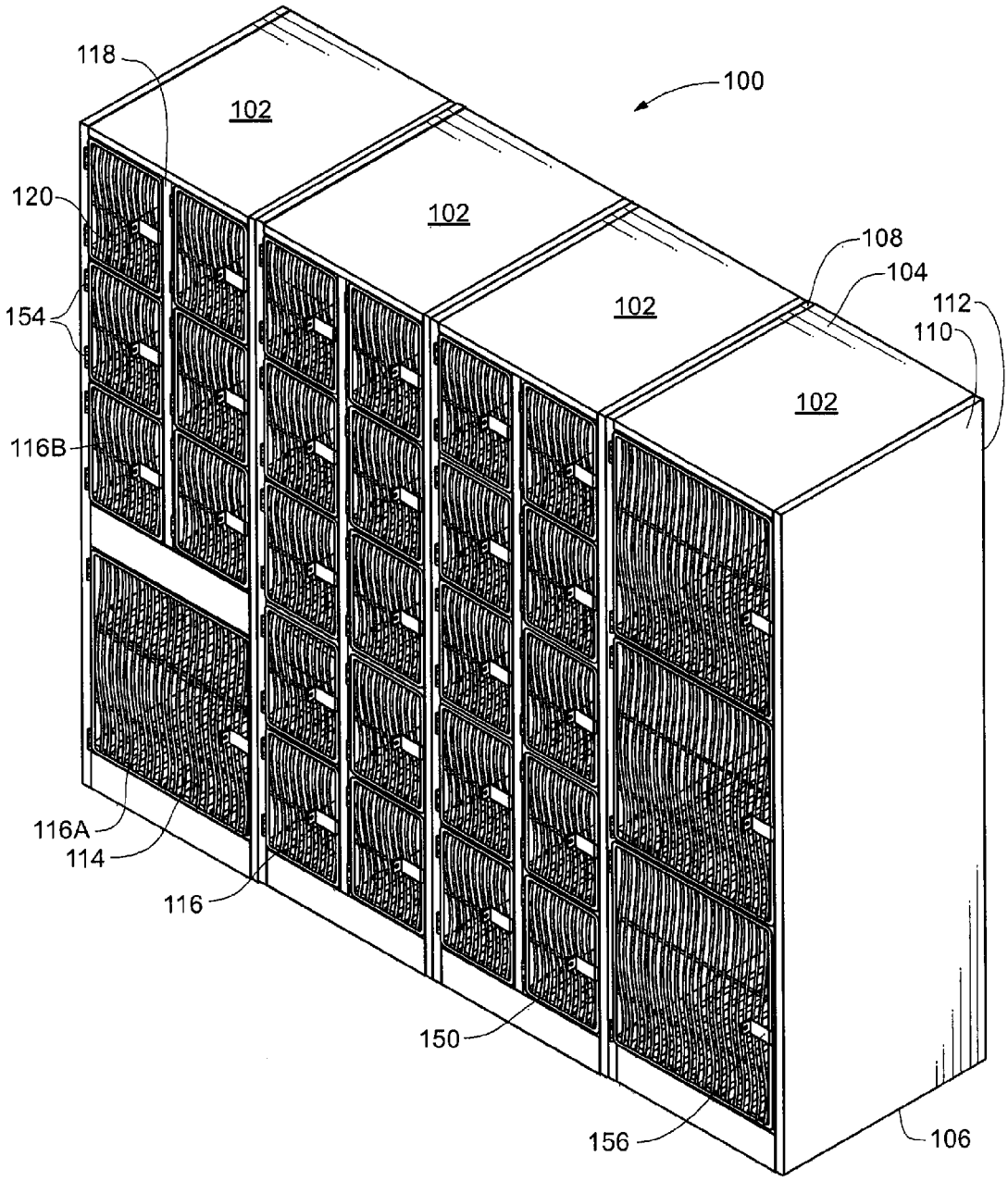
FIG. 1 is a perspective view of an acoustic cabinet according to the present disclosure.
Figure 2:
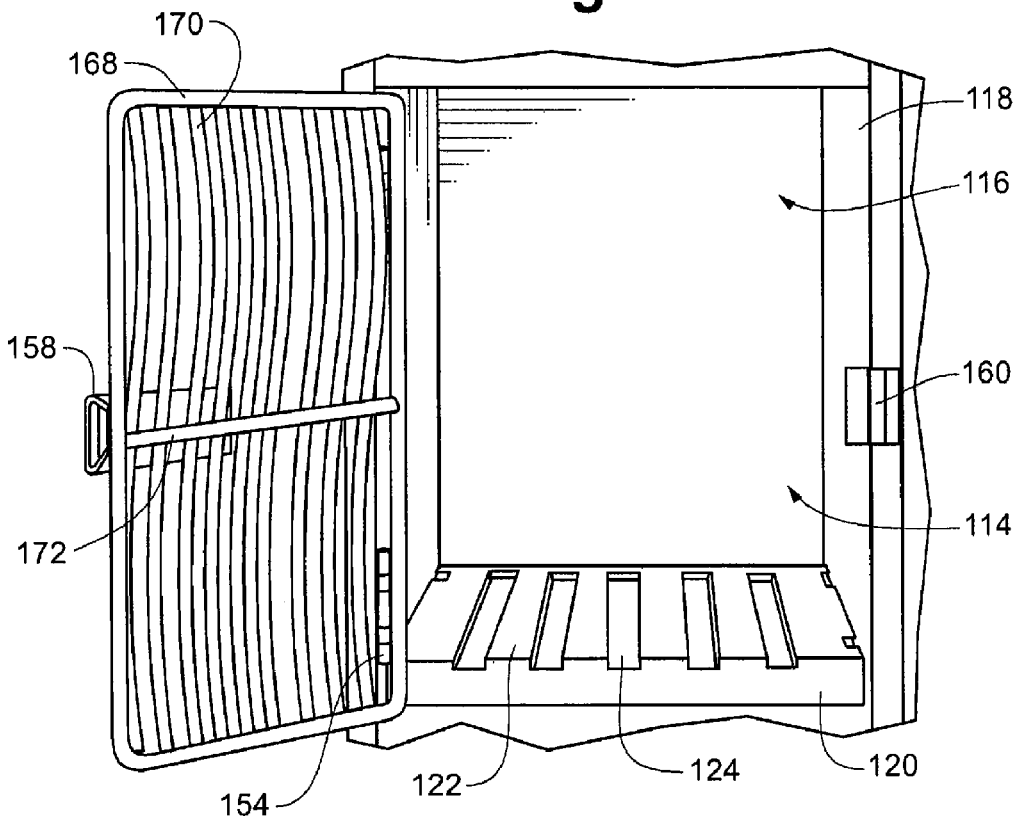
FIG. 2 is a front view of an individual storage unit of an acoustic cabinet according to the present disclosure.

Referring to FIGS. 1 and 2, an acoustic cabinet 100 for the storage of musical instruments according to the present disclosure can include one or more storage portions 102. Each storage portion 102 can include a top panel 104 and opposing bottom panel 106, first 108 and second 110 opposing side panels, and a rear panel 112, all of which define an open interior 114. Interior 114 can be divided into a plurality of individual storage units 116, each with a door 150. One or more divider panels 118 can separate interior into columns and storage shelves 120 can be inserted to define rows.

Storage shelves 120 can include ridges 122 and ventilation channels 124 to ensure adequate air flow through storage shelves, which can be crucial to musical instrument, equipment, and garment longevity. A suitable storage shelf for use in an acoustic cabinet according to the present disclosure is disclosed in U.S. Pat. No. 4,826,265 (assigned to Wenger Corporation), which is hereby incorporated by reference. Shelves 120 and divider panels 118 can be added, removed, and otherwise adjustable to change the size of individual storage units 116, which can be configured to fit virtually any size instrument. For example, larger individual storage units, such as individual storage unit 116A can be used to accommodate larger instruments, such as baritones and bassoons, and smaller individual storage units, such as individual storage unit 116B, can be used to accommodate smaller instruments, such as flutes and clarinets. Individual storage unit 116 sizes can vary or remain constant within a single storage portion 102. Tamper-resistant attachments can be used to secure storage shelves 120 in place to help deter theft and prevent damage to instruments.

Rear panel 112 of storage portion 102 can comprise a sound-absorbing panel and may be made from a sound-absorbing material. Sound-absorbing panels can be comprised of a porous material, such as, for example, fiberglass batting, fiberglass boards, melamine foam, or cotton batting. In general, the thicker the sound-absorbing material is, the greater the sound absorption will be in part because thicker sound absorbing material allows for increased low frequency absorption. However, size constraints of rehearsal rooms and cost considerations will tend to limit the usable thickness. A preferred thickness is 3-4 inches because it provides adequate sound absorption while not taking up an overly large amount of space, but usable thicknesses can be as small as 1 inch. Where desired, acoustic cabinets 100 can be pushed tightly against a wall to reduce the thickness of the material (which reduces low frequency absorption). If a greater material thickness is desired, multiple sound-absorbing panels can be positioned back-to-back to increase overall thickness of the rear panel 112.

Figure 3A:
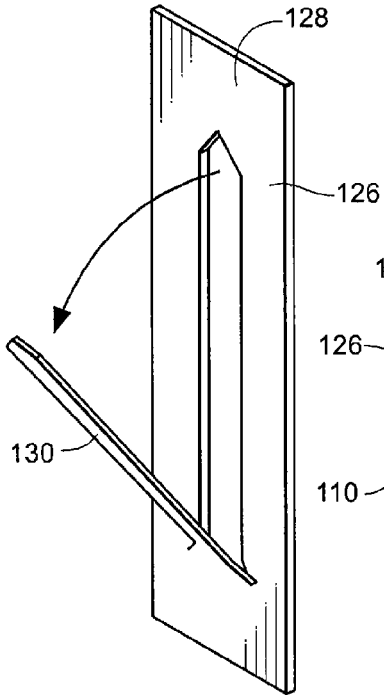
FIG. 3A depicts a mounting hook that can be used for attaching an acoustic panel to an acoustic cabinet according to the present disclosure.
Figure 3B:
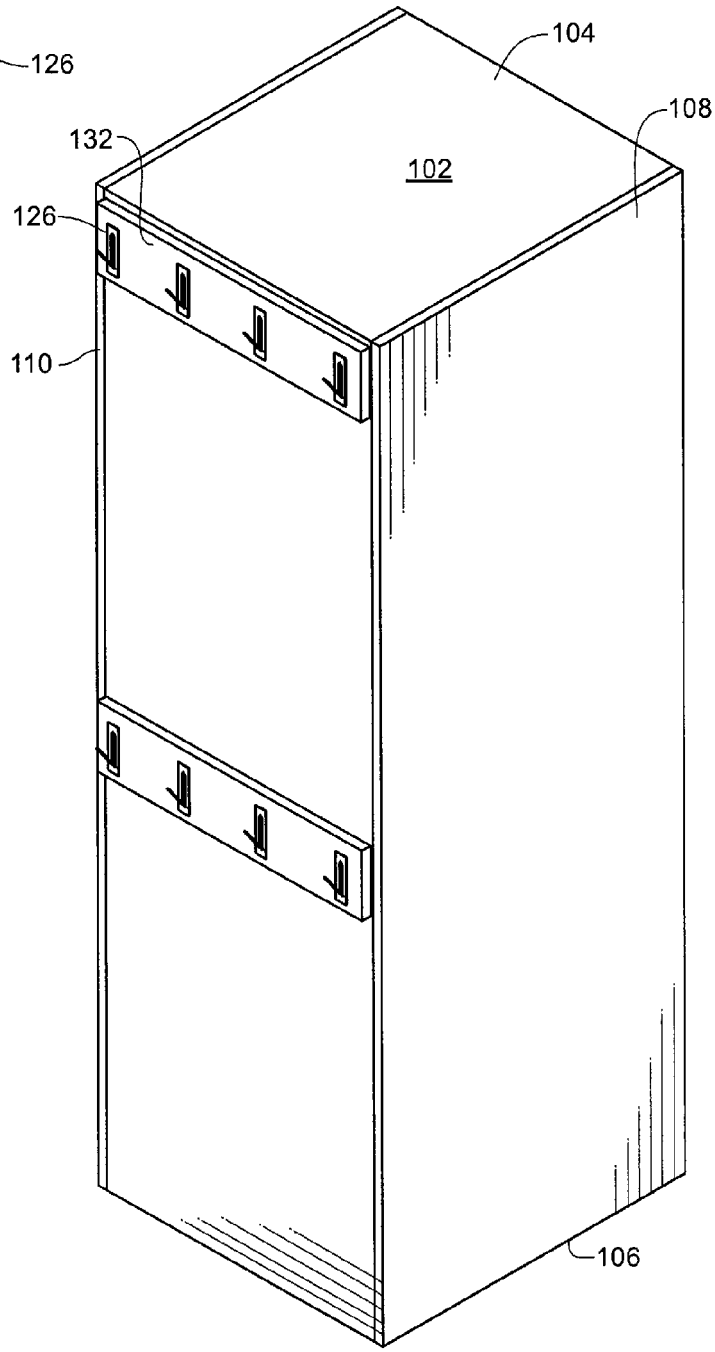
FIG. 3B is a rear perspective view of an acoustic cabinet according to the present disclosure.

Rear panel 112 can include a single sound-absorbing panel that covers the rear of all storage units 116, or can include a plurality of individual sound-absorbing panels that cover a smaller area, such as the back wall of individual storage units 116 or individual rows of storage units 116. Sound-absorbing panels can be hung on mounting frames 126 attached to storage portion, depicted in FIGS. 3A and 3B. Mounting frames 126 can include an attachment portion 128 and a hook portion 130. Mounting frames 126 can be installed in a horizontally spaced-apart pattern across storage portion 112 between first 108 and second 110 side panels, or between side panels and divider panels, by securing attachment portion 128 to a mounting board 132 or other area of storage portion 102. Sound absorbing panels can be mounted on mounting frames 126 (e.g., by puncturing an outer layer of sound absorbing panels with hook portion 130). Mounting frames 126 thereby provide for easy replaceability of sound-absorbing panels in case of damage. This replaceability also allows sound-absorbing panels to be easily interchanged in case a differently configured panel is desired.

Because sound-absorbing panels will typically be made of a material that could be damaged when instruments and other objects inserted into storage units 116 are pushed against rear panel 112, a protective backing element, such as a metal grill or perforated hardboard, can be disposed between sound-absorbing panels and storage units. A protective backing element can simultaneously serve to protect sound-absorbing panels from damage while allowing sound to reach and be absorbed by the sound-absorbing panels. So long as the protective backing element comprises sufficient open area, it will not interfere with the sound absorption of the sound-absorbing panels. Open area of 24% or greater is typically sufficient. Another protective backing that can be disposed between storage units and sound-absorbing panels is steel or aluminum mesh. In addition, an acoustic fabric, such as Guilford or Shaw fabric, can be used to protect the sound-absorbing panels while still allowing sound to reach them.

Figure 4:
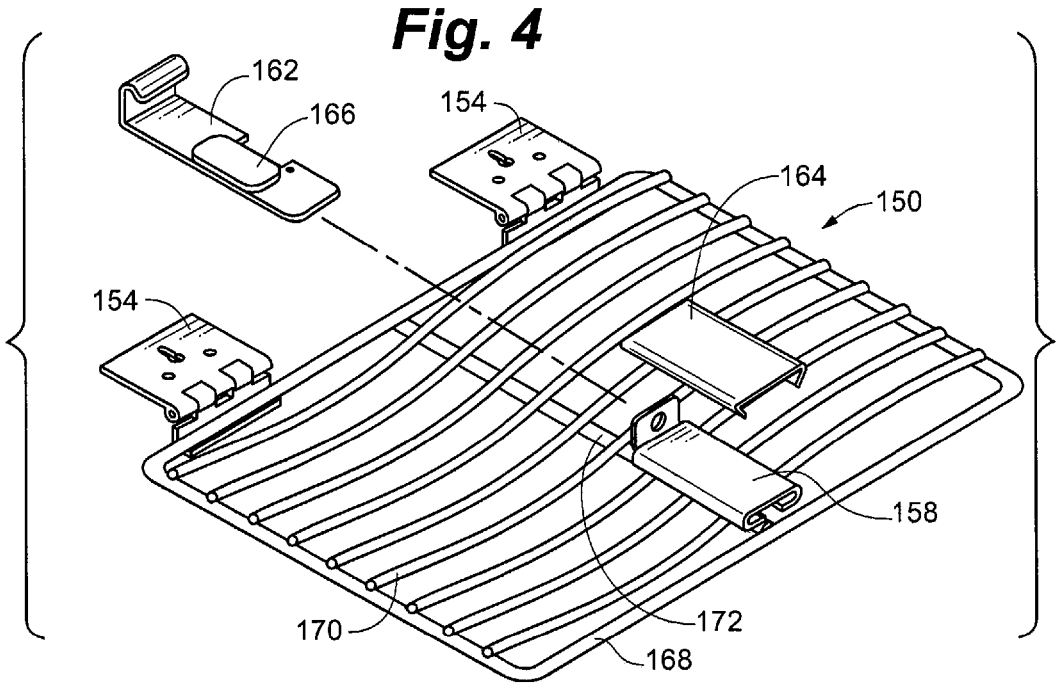
FIG. 4 is an exploded view of a door of an acoustic cabinet and optional hardware according to the present disclosure.
Figure 5A:
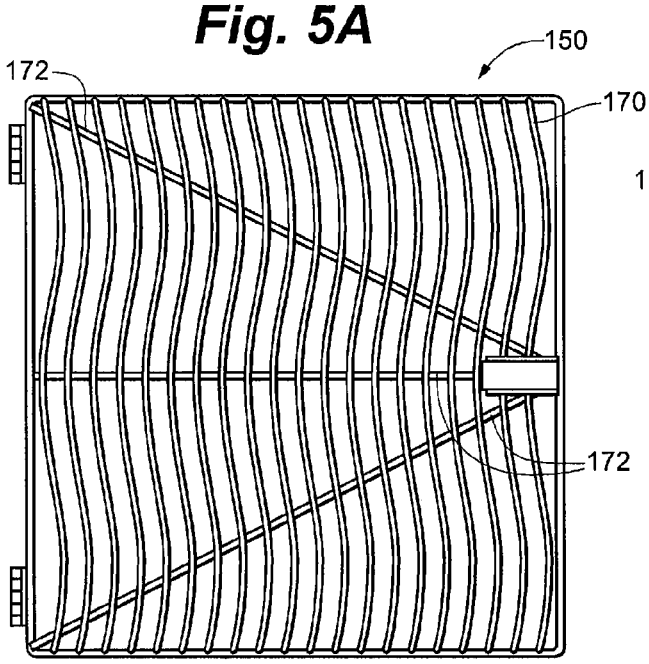
FIGS. 5A-5D are exemplary door configurations for acoustic cabinets according to the present disclosure.
Figure 5B:
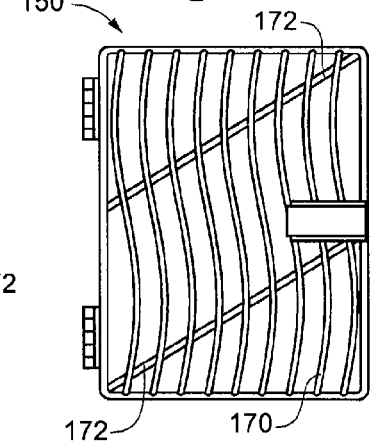
Figure 5C:
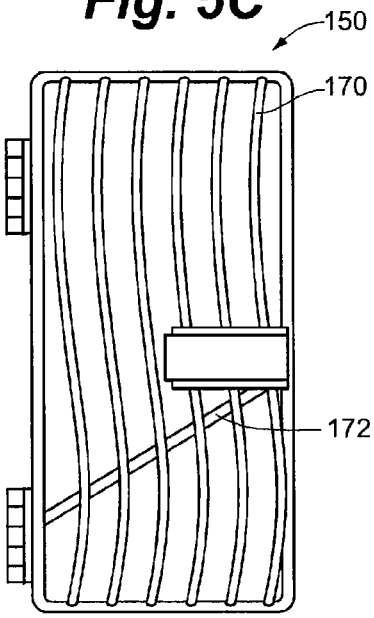
Figure 5D:
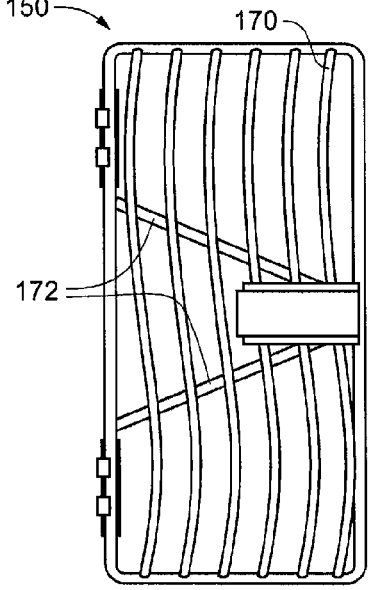
Figure 6:
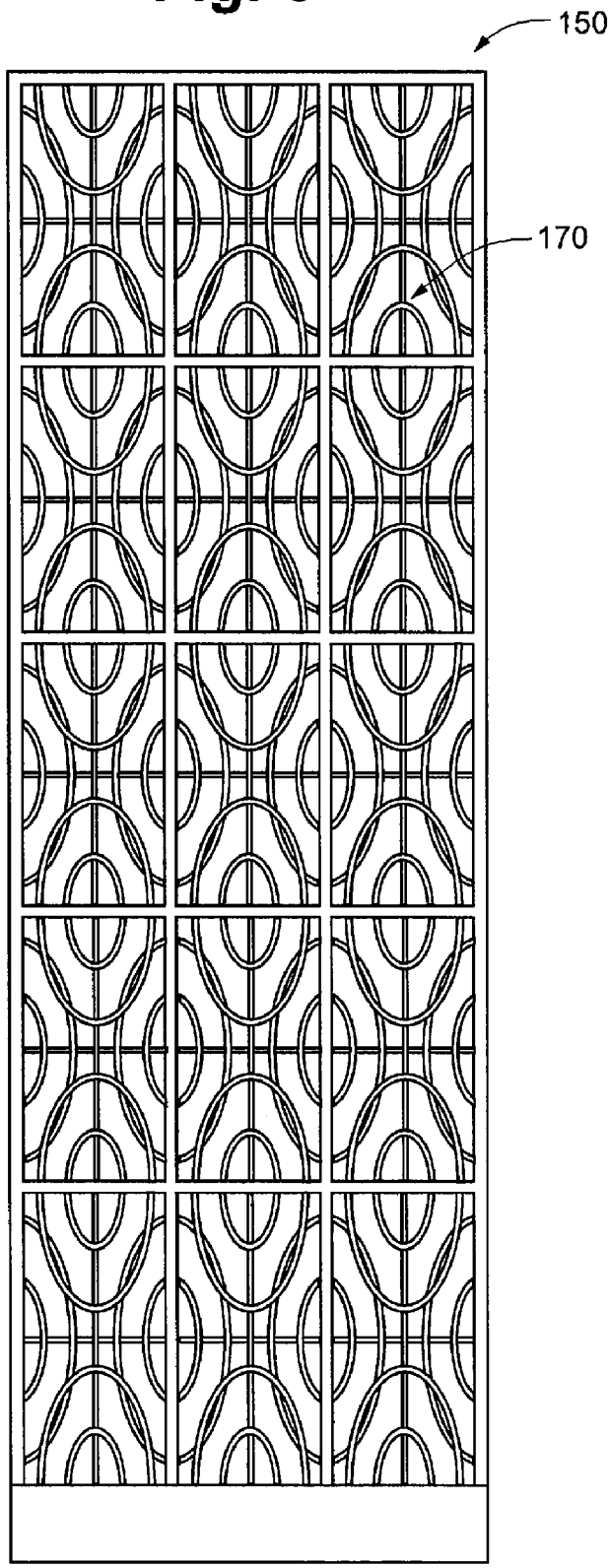
FIG. 6 is an exemplary door configuration for an acoustic cabinet according to the present disclosure.
Figure 7:
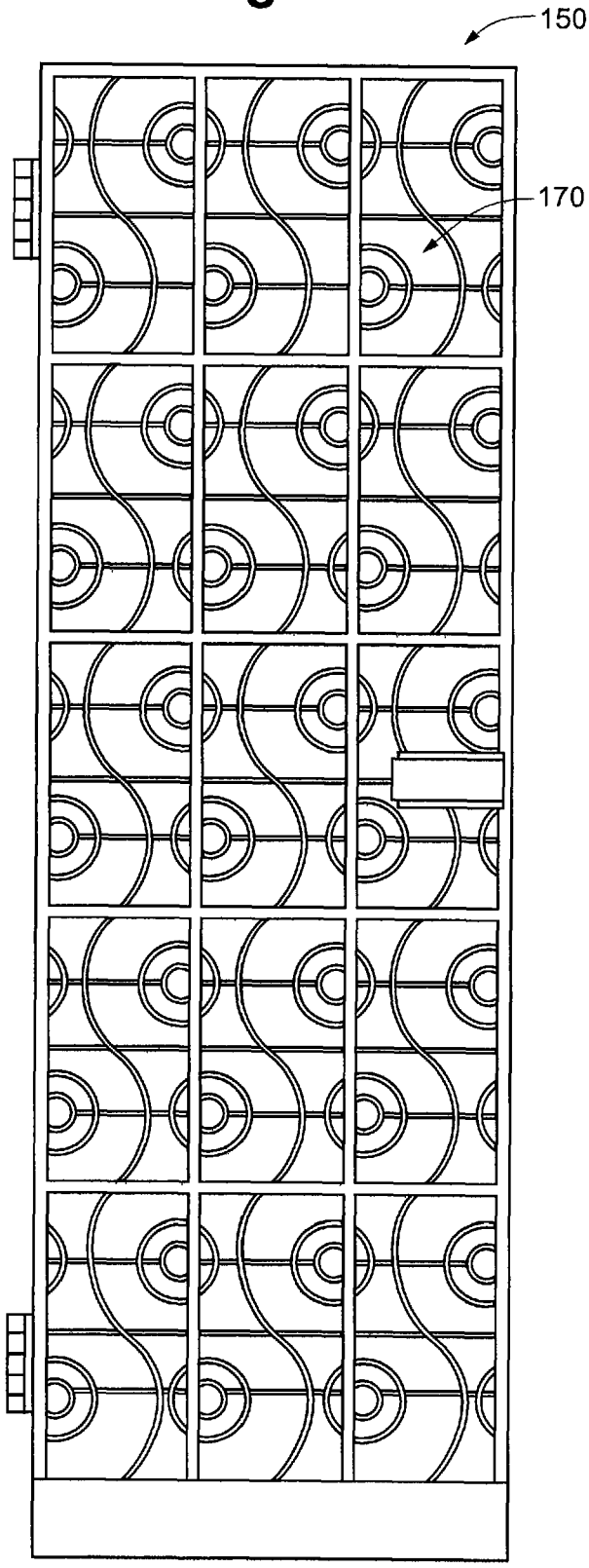
FIG. 7 is an exemplary door configuration for an acoustic cabinet according to the present disclosure.
Figure 8:
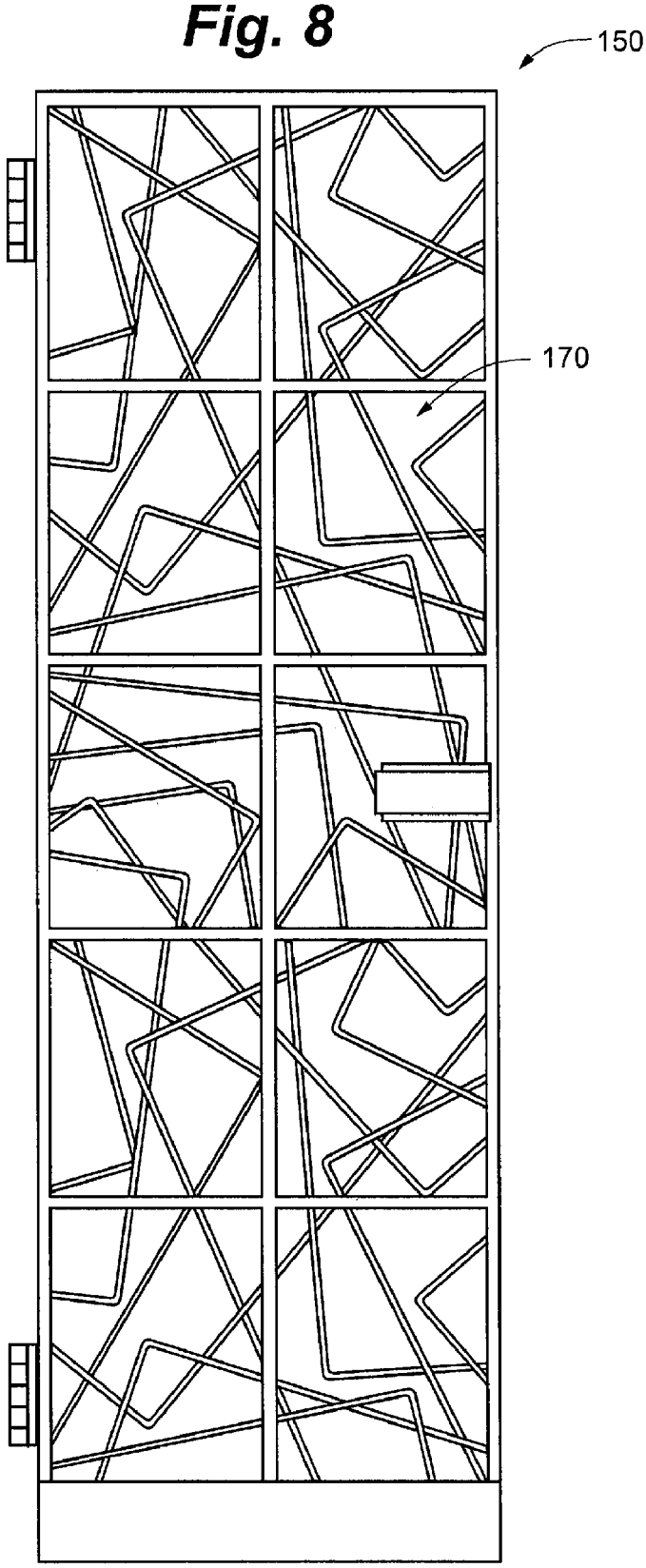
FIG. 8 is an exemplary door configuration for an acoustic cabinet according to the present disclosure.
Figure 9:
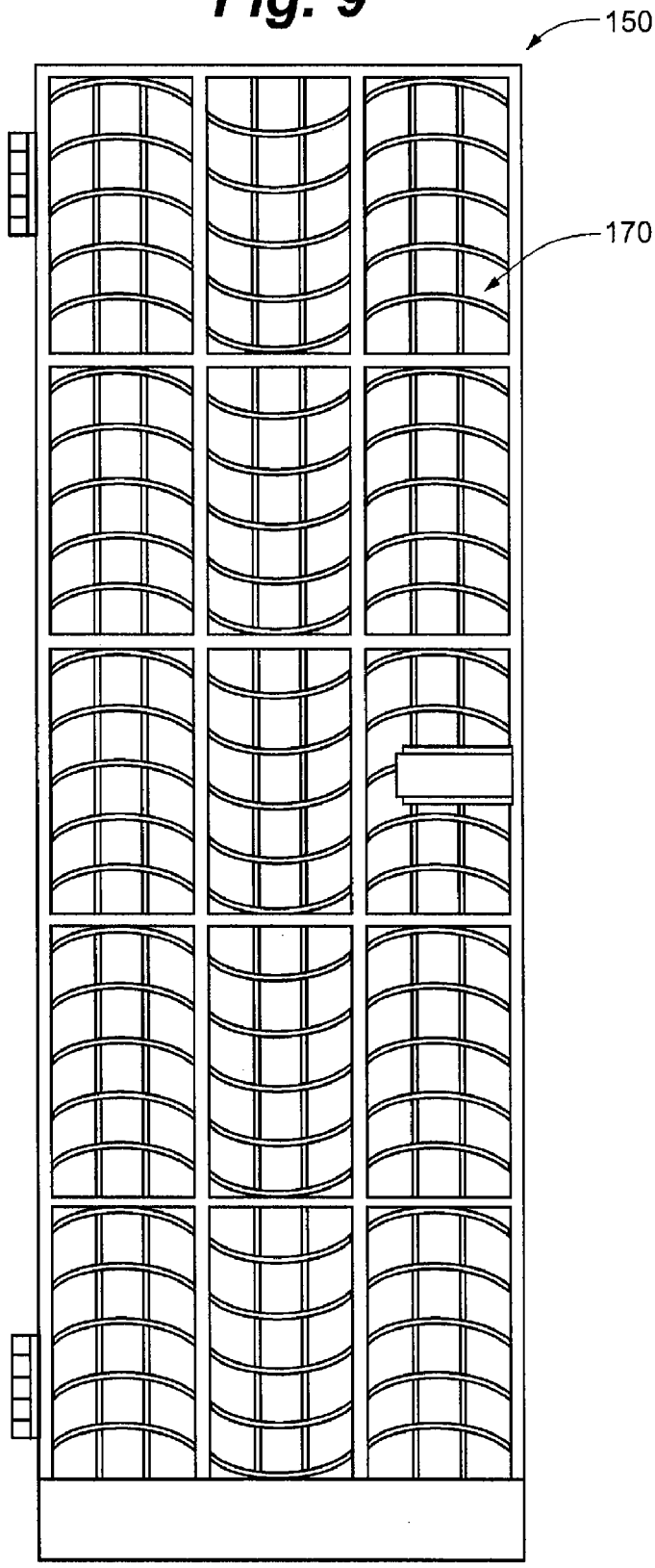
FIG. 9 is an exemplary door configuration for an acoustic cabinet according to the present disclosure.
Figure 10:
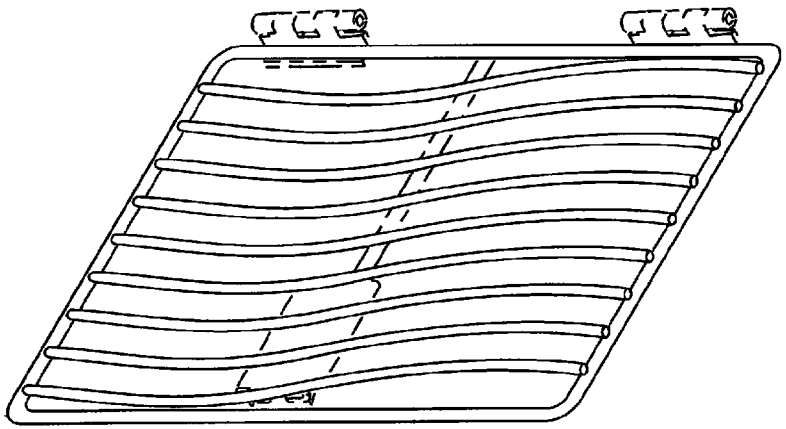
FIG. 10 is a top front perspective view of an exemplary door configuration for an acoustic cabinet according to the present disclosure.
Figure 11:
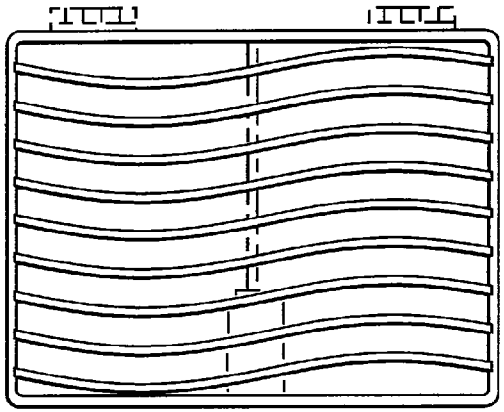
FIG. 11 is a front elevational view of an exemplary door configuration for an acoustic cabinet according to the present disclosure.
Figure 12:
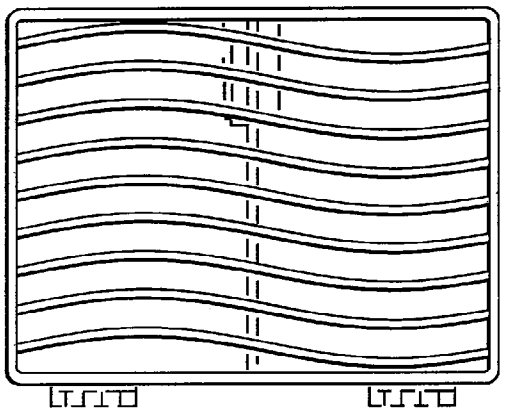
FIG. 12 is a rear elevational view of an exemplary door configuration for an acoustic cabinet according to the present disclosure.
Figure 13:
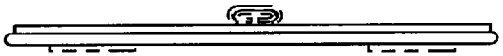
FIG. 13 is right side elevational view of an exemplary door configuration for an acoustic cabinet according to the present disclosure.
Figure 14:
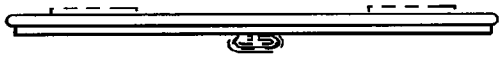
FIG. 14 is a left side elevational view of an exemplary door configuration for an acoustic cabinet according to the present disclosure.
Figure 15:
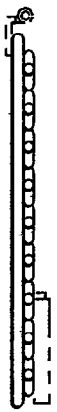
FIG. 15 is a top plan view of an exemplary door configuration for an acoustic cabinet according to the present disclosure.
Figure 16:
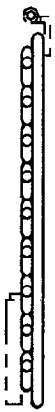
FIG. 16 is a bottom plan view of an exemplary door configuration for an acoustic cabinet according to the present disclosure.

A door 150 can cover each individual storage unit 116. Alternatively, a full or double full door can cover the entire opening of acoustic cabinet 100. Referring to FIGS. 1, 2, and 4, one side of each door 150 can include one or more hinges 154 that can be fastened to first 108 or second 110 opposing side panels, or a divider panel 118, of storage portion 102. The opposite side of each door 150 can include a latch 156 used to open and close each door 150. One suitable latch that may be used with an acoustic cabinet according to the present disclosure is disclosed in U.S. Pat. No. 4,826,265. Latch 156 can include a lock housing 158 attached to the door 150 and a lock receiver 160 attached to storage portion 102. A locking slide 162 can slidably attach to lock housing 158 and can interlock it with lock receiver 160 to hold the door 150 shut. Door 150 can be unlatched by sliding the locking slide 162 out of the lock receiver 160. A card holder 164 can also be attached to lock housing 158 to contain an identification card for the storage unit. Latch 156 can further include a silencer 166 that can be affixed to the locking slide 162. The silencer 166 can be comprised of a soft material, such as, for example, foam, and serves to reduce noise caused by the hard (typically metal) surfaces of lock housing 158 and locking slide 162 banging together when door 150 is opened and closed. Lock housing 158 and locking slide 162 can further define complementary apertures by which a padlock can be secured to prevent unlatching. Hinges 154 and latches 156 can be attached to acoustic cabinet 100 with tamper-proof bolts that run completely through the door 150 into the cabinet walls to help deter theft and prevent damage to instruments.

Door 150 can have a substantially open, grill-like configuration, including a frame 168 and a plurality of grill bars 170. This configuration allows sound to travel into the open interior of acoustic cabinet, which diffuses the sound and thereby lessens the acoustical impact of the cabinet in the room. This can also allow more sound to be absorbed by the sound-absorbing panels that can be located on the rear of acoustic cabinet. The frame of each door can be formed from a single piece of metal, bent into the desired size and shape and welded together. The individual grill bars can be shaped, the edges beveled to align with the frame, and welded to the frame. The hinges and latch can also be welded to the frame.

The individual grill bars 170 of each door 150 can have a non-linear, curved configuration. This creates "looser" grill bars 170 that have varying stresses on the inside and outside of the curves, which increases the energy required to cause the bars to resonate. Further, because the mass of the grill bars has the greatest effect on the energy required to make the bars resonate, ¼ inch thick diameter grill bars made of metal, for example, can be used to decrease the chance of resonance. Although grill bars thicker than ¼ inch can further increase the energy required for resonance, cost factors may dictate against providing thicker bars and ¼ inch should be thick enough to resist resonance in a typical rehearsal room. Grill bars can also be dipped in vinyl, epoxy, resin or rubber to increase their mass and further reduce the possibility and/or extent of resonance.

Non-linear grill bars 170 can be oriented generally vertically and door 150 can include a horizontal cross bar 172, as can be seen in FIGS. 1, 2, 4, and 10-16. As exemplified by FIGS. 2A-2D, door 150 can include one or more cross bars 172 having a variety of other configurations, such as, for example, horizontal, angled, arcuate and V-shaped. Where cross bar 172 divides grill bars into uneven lengths, the likelihood of an undesirable resonant effect is even further reduced, because each grill bar portion of a different length will resonate at a different frequency.

Referring to FIGS. 6-9, door 150 can have a variety of other configurations. Grill bars 170 can be any combination of horizontal, vertical, angled, or non-linear. The likelihood of resonance is reduced by each of the depicted doors 150 because each has non-linear grill bars and/or straight grill bars of different lengths. Each door 150 also allows sound to reach the interior of an acoustic cabinet. The doors 150 depicted in the Figures are exemplary only, as one of ordinary skill in the art with the benefit of the present disclosure will recognize any number of other grill bar configurations that could be used with an acoustic cabinet in order to reduce the likelihood of resonance while allowing sound to reach a rear, sound-absorbing panel.

Acoustic cabinets 100 according to the present disclosure are advantageous because they allow the acoustical performance of a rehearsal room to be enhanced with equipment that must necessarily be purchased anyway in order to store musical instruments. Acoustic cabinets 100 can be strategically placed throughout a rehearsal room to provide for maximum enhancement of acoustical performance. Different materials can also be used in different locations around the room and various non-parallel surfaces can be added. New rehearsal rooms can be designed with the optimum placement of acoustic cabinets 100 in mind. Existing rehearsal rooms can also be retrofit with acoustic cabinets 100 to enhance their acoustic performance. Strategic placement can involve situating acoustic cabinets 100 nearest to instruments that are the loudest and/or produce the lowest frequencies. This approach often results in acoustic cabinets 100 being placed along the back wall and/or the back portion of the side walls of a rehearsal room.

Sound-absorbing panels on the rear of acoustic cabinets 100 can reduce, and even eliminate, the need for wall mounted sound-absorbing panels, which increases the flexibility and interchangeability of a room's sound absorption capabilities. This is also advantageous in smaller rehearsal rooms that would not have space for additional sound-absorbing panels. A door 150 with a grill-like configuration allows sound to reach the sound absorbing panels and also increases acoustical performance by increasing the cubic volume of the room (due to the open interior) and serves to diffuse sound that isn't absorbed. In addition, the grill bars 170 can be configured so as to greatly reduce the resonance of the door 150. Flutter echo is also reduced by use of acoustic cabinets 100. Flutter echo occurs when sound reflects back and forth between two hard, parallel, flat surfaces, such as walls or solid cabinet doors in a rehearsal room. By absorbing sound, acoustic cabinets 100 reduce or eliminate these sound reflections, thereby reducing or eliminating flutter echo.

A combination of an open grill door 150 and rear sound-absorbing panels allows acoustic cabinets 100 to be "net absorbers," as opposed to "net reflectors." This means that acoustic cabinets 100 can absorb more sound than they reflect, which greatly enhances the acoustical performance of any rehearsal room in which they are installed.

The invention claimed is:

1. A cabinet for the storage of musical instruments, the cabinet comprising:

a storage portion comprising a top panel, a bottom panel, and a pair of side panels, the storage portion dividable into a plurality of storage units, each storage unit including structure defining a storage unit interior, a storage unit front opening, and a storage unit rear opening opposite the storage unit front opening;

a plurality of doors, each of the plurality of doors coupled to a respective storage unit proximal the storage unit front opening of the respective storage unit and configured to at least partially cover the storage unit front opening of the respective storage unit; at least one mounting frame operably coupled to the storage portion adjacent at least one storage unit rear opening; and an interchangeable sound-absorbing panel detachably carried by the at least one mounting frame to substantially, removably cover at least one storage unit rear opening, wherein the interchangeable sound-absorbing panel is attachable and detachable to the mounting frame without disassembly of the storage portion.

2. The cabinet of claim 1, further comprising at least one divider panel and at least one storage shelf for dividing the storage portion into the plurality of storage units.

3. The cabinet of claim 2, wherein the storage shelf defines a plurality of ridges and ventilation channels.

4. The cabinet of claim 2, wherein the storage shelf is adjustable with respect to the top and bottom panels.

5. The cabinet of claim 1, wherein the at least one mounting frame comprises a plurality of hooks.

6. The cabinet of claim 1, further comprising:

a backing element intermediate the sound-absorbing panel and the storage portion, the backing element including an acoustically permeable structure for allowing a first set of sound waves to pass through the storage unit to the sound-absorbing panel and reflecting a second set of sound waves through one of the plurality of storage units to the storage unit front opening of the respective storage unit.

7. The cabinet of claim 1, wherein the sound absorbing material comprises a substantially porous material.

8. The cabinet of claim 7, wherein the sound absorbing material is selected from the group consisting of: fiberglass batting, fiberglass board, melamine foam, and cotton batting.

9. The cabinet of claim 1, wherein the door comprises a plurality of intersected grille bars forming a grille, at least two of the intersected grille bars configured to resonate at different frequencies.

10. The of claim 9, wherein the plurality of intersected grille bars form a non-linear, curved configuration.

11. The cabinet of claim 1, wherein the sound-absorbing panel and the backing element define a semi-anechoic zone proximal at least one storage unit rear opening.

12. The cabinet of claim 10, wherein each of the intersected grille bars is intersected by a cross bar.

13. The cabinet of claim 12, wherein the plurality of intersected grille bars is oriented generally vertically and the cross bar is oriented generally horizontally.

14. The cabinet of claim 1, further comprising:

at least one hinge operably coupling the door to the storage portion; and a latch for securing the door in a closed position, the latch configured to attenuate noise when the door is shifted between the closed position and an open position.

15. The cabinet of claim 10, wherein the intersected grille bars are coated with a material selected from the group consisting of: vinyl, epoxy, resin, and rubber.

16. The cabinet of claim 6, wherein the acoustically permeable structure presents a total area defining an open area, the open area at least approximately twenty-four percent of the total area.

17. The cabinet of claim 16, wherein the open area allows the first set of sound waves to directly reach the sound-absorbing panel.

18. The cabinet of claim 1, wherein each of the plurality of doors substantially diffuses sound entering the front opening of the storage portion.

19. A cabinet for the storage of musical instruments, the cabinet comprising:

a storage portion comprising a top panel, a bottom panel, and a pair of side panels, the storage portion dividable into a plurality of storage units, each storage unit including structure defining a storage unit interior, a storage unit front opening, and a storage unit rear opening opposite the storage unit front opening;

at least one mounting frame operably coupled to the storage portion adjacent at least one storage unit rear opening; and an interchangeable sound-absorbing panel detachably carried by the at least one mounting frame to substantially, removably cover at least one storage unit rear opening, wherein the interchangeable sound-absorbing panel is attachable and detachable to the mounting frame without disassembly of the storage portion.

20. A cabinet for the storage of musical instruments, the cabinet comprising:

a storage portion comprising a top panel, a bottom panel, and a pair of side panels, the storage portion dividable into at least one storage unit, the at least one storage unit including structure defining a storage unit interior, a storage unit front opening, and a storage unit back opening opposite the storage unit front opening;

a door coupled to the at least one storage unit proximal the storage unit front opening and configured to at least partially cover the storage unit front opening of the at least one storage unit;

at least one mounting frame operably coupled to the storage portion adjacent at least one storage unit rear opening; and an interchangeable sound-absorbing panel detachably carried by the at least one mounting frame to substantially, removably cover the at least one storage unit rear opening wherein the interchangeable sound-absorbing panel is attachable and detachable to the mounting frame without disassembly of the storage portion.

* * * * *

UNITED STATES PATENT AND TRADEMARK OFFICE

CERTIFICATE OF CORRECTION

PATENT NO. : 7,921,960 B2
APPLICATION NO. : 11/828932
DATED : April 12, 2011
INVENTOR(S) : Jacobson et al.

It is certified that error appears in the above-identified patent and that said Letters Patent is hereby corrected as shown below:

Column 2, Line 19:
Delete "room" and insert --rooms--.

Column 2, Line 32:
Before "door" insert --the--.

Column 2, Lines 33, 35, 40:
Before "acoustic" insert --the--.

Column 3, Line 37:
After "interior" insert --114--.

Column 4, Line 17:
Delete "portion" insert --portions 120--.

Column 5, Lines 13, 16:
After "acoustic cabinet" insert --100--.

Signed and Sealed this
Fourth Day of September, 2012

David J. Kappos

David J. Kappos
*Director of the United States Patent and Trademark Office*